United States Patent [19]

Dannatt

[11] 4,188,137

[45] Feb. 12, 1980

[54] LOW SILHOUETTE KEYBOARD

[75] Inventor: Hugh St. L. Dannatt, Bethal, Conn.

[73] Assignee: SCM Corporation, New York, N.Y.

[21] Appl. No.: 859,425

[22] Filed: Dec. 12, 1977

[51] Int. Cl.[2] ..... B41J 5/08

[52] U.S. Cl. ..... 400/496; 400/440.2; 400/438; 400/481; 400/495.1

[58] Field of Search ..... 400/438, 440, 440.1, 400/440.2, 472, 477, 479, 479.1, 479.2, 480, 481, 495.1, 496, 694

[56] References Cited

U.S. PATENT DOCUMENTS

| | | | |
|---|---|---|---|
| 1,120,726 | 12/1914 | Lorenz | 400/496 X |
| 2,209,227 | 7/1940 | Helmond | 400/481 X |
| 2,890,782 | 6/1959 | Stuiber | 400/438 |
| 3,457,368 | 7/1969 | Houcke | 400/479 X |
| 3,616,886 | 11/1971 | Dannatt | 400/481 X |
| 3,633,723 | 1/1972 | Kosters | 400/694 X |
| 3,789,970 | 2/1974 | Costa | 400/480 |
| 3,934,696 | 1/1976 | Mueller et al. | 400/438 |
| 3,974,905 | 8/1976 | Johnson | 400/440 X |

FOREIGN PATENT DOCUMENTS

| | | | |
|---|---|---|---|
| 229432 | 12/1910 | Fed. Rep. of Germany | 400/496 |
| 901294 | 1/1954 | Fed. Rep. of Germany | 400/440.1 |
| 1915292 | 12/1970 | Fed. Rep. of Germany | 400/496 |
| 2557953 | 6/1977 | Fed. Rep. of Germany | 400/694 |
| 308466 | 9/1971 | U.S.S.R. | 400/479.2 |

*Primary Examiner*—Ernest T. Wright, Jr.

*Attorney, Agent, or Firm*—William E. Mear, III; Milton M. Wolson; Ernest F. Weinberger

[57] ABSTRACT

A low silhouette keyboard having a plurality of keylevers arranged in rows and in parallel relationship to one another are suspended, guided and biased to restore by opposing flexible support members. The keylevers are "T" shaped which includes a cross arm constrained between the flexible support members, and a leg portion which projects through slots in a single guide comb. The keylevers are suspended in cantilever fashion being biased upward limited by an upstop. Reciprocation of any keylever in any row is a path substantially perpendicular to the plane of the flexible support members. Keytouch of all keylevers is substantially simultaneous and uniformly adjustable by providing means for varying the upward biasing force applied thereto.

10 Claims, 4 Drawing Figures

LOW SILHOUETTE KEYBOARD

BACKGROUND OF THE INVENTION

The present invention relates to keyboards for business machines and more particularly to a typewriter having a low silhouette keyboard. The present invention keyboard includes keylevers that are arranged in multiple rows and suspended, biased, and guided transverse the keyboard by opposed cantilever mounted flexible support members at one end in cooperation with a single guide comb at its other end.

Typically, keyboards employed for use in business machines such as typewriters, include keylevers having a common pivot for the several rows of keys. It is desirable that the amount of angular keylever depression required for actuation of corresponding mechanism be consistent between rows. This requires that each row include a different design of the key mechanism for limiting key depression. A common solution for equalizing the dip of pivoting keylevers is for each row to vary the distance from the keylever stopping surface to its downstop limit.

It is also desirable in keyboard design that the reacting biasing force supplied for depression and restoration of the different keylevers of different rows be substantially equal. Pivoting keylevers have different lengths between the point of depression and its pivot for each row. The keylevers having the longest length have a greater mass and have a greater mechanical advantage than shorter keylevers and thus require different reacting forces applied thereto. Devices are often employed for equalizing the reacting force applied to the keylevers of different rows. Springs having various tensions were employed to bias the keys to their rest and restore positions to thereby equalize the force necessary to depress the different length keylevers. Very often the force required to depress the different keylevers varied substantially. Substantial variation of keylever depression force may result in non-acceptable print density of various printed characters. Mechanical means were often employed to adjust the degree of tension of such keylever spring devices to equalize the depressing force between the keylevers.

It is further desirable as a convenience for the operator, that keyboards include mechanism for adjusting the keytouch of all keylevers.

To overcome these deficiencies, attempts were made to improve the structure of the keylever and the biasing means attached thereto. One such example is U.S. Pat. No. 3,789,970 granted to George Costa, which discloses a keyboard having a plurality of keylevers disposed transverse the typewriter. The keylevers are biased to their rest and restore positions by two aligned rows of flexible members. The flexible members are disposed on a rigid U-shaped member in parallel spaced relationship. The keylevers are guided in their movement by dual guide combs at each end of the keylevers.

The Costa patent is an improved keyboard construction, in that it allowed for a substantially parallel depression, requiring substantially uniform reacting forces for depression and restoration among all keylevers with little friction during movement. The construction has a disadvantage in that an upper flexible member is tensioned, and a lower member is compressed during keylever depression. The lower compressed flexible member is capable of buckling which may result in an undesirable keylever motion. Such buckling further tends to reduce the life of the compressed flexible member. The construction has another disadvantage in that the keylevers were guided in guide combs located at both extremeties of the keylevers. This has a disadvantage of being a costly dual comb construction. The Costa patent further, does not disclose any mechanism for providing the desired adjustable keytouch feature. Additionally, the construction has a disadvantage by limiting this keyboard to a high silhouette.

The phrase "low silhouette" in this disclosure refers to a keyboard profile having minimal distance between key tops and the surface on which the machine rests. A low silhouette keyboard provides equal dip for all keylevers irrespective of row location and without having different key mechanism designs between the rows for limiting key depression. Additionally, since the path the keylever reciprocates is substantially perpendicular to the reacting biasing keylever force, and the mass of all keylevers is substantially the same, the necessary biasing force applied to all keylevers is substantially equal.

My U.S. Pat. No. 3,616,886 issued Nov. 2, 1971 discloses a low silhouette keyboard having equal dip keylevers. The construction of this keyboard includes a sagging four bar linkage pivotally connected on each keylever. When the keylever is depressed, a solenoid actuated bail moves a spring biased slide rearward into a ball interlock. There is a slide provided adjacently below each keylever. My present invention avoids the above design complexities which add to the manufacturers cost. The construction has another disadvantage, in that the compact profile is limited by having a portion of the slide located below the keylevers. A further disadvantage is that the keyboard does not include design for a keytouch adjustment mechanism.

Another example attempting to equalize the biasing keylever reacting force, is U.S. Pat. No. 3,974,905 issued Aug. 17, 1976 to Wendell C. Johnson. This patent discloses a unitary molded key mechanism having key arms with a single cantilever pivot point. The biasing key arm tension is equalized by varying the cross-sectional area of the key arms proportional to the length thereof. The key mechanism includes a support post formed at an angle onto which keys can be mounted, an actuating stem extending below the pivoting key arm for actuating mechanism. The key mechanism also includes a key arm guide and a stabilizing member that extends into guide slots of a guide plate.

The construction has a disadvantage by limiting this keyboard to a high silhouette, by having stems extending downward cooperating with actuating mechanism. Further, the key posts are formed at an angle to compensate for upward tilting of the key mechanism. This construction has another disadvantage of employing costly dual guide members. With one guide member at an end of the key arm and another below the key arm, the relationship of both must be properly aligned to permit the key arm to function properly without binding.

SUMMARY OF THE INVENTION

Multiple keylevers are arranged in parallel rows to define a frame supported keyboard for a typewriter having a low silhouette. The keylevers are suspended, biased, and guided at one end by opposing horizontal first and second flexible keylever support members mounted in cantilever fashion and at the other end by a rigid guide comb. The term "keylever" as herein referred to, includes a "T" shaped structure having a cross arm and a leg, integrally connected intermediate ends of the cross arm, that extends therefrom toward the guide comb. A finger-engageable keybutton is supported on each keylever leg for vertical depression of the selected key. The keylevers are positioned such that the cross arm is vertically orientated relative to the horizontal flexible keylever support members. The flexible keylever support members include flexures that extend from their mounted end toward the keylevers in opposite directions. Each flexure is connected to the cross arm of the keylever for biasing support and guidance thereof. The first flexible support member is connected to the cross arm at one end above the leg and similarly the second flexible support member is connected to the cross arm at an end below the leg.

The guide comb is supported transverse the keyboard and includes multiple keylever receiving slots through which the front portion of the keylever leg projects and further includes a resilient keylever upstop against which the keylevers are biased to define a keylever rest position. The keylevers are suspended, guided and biased to restore to their rest position by virtue of the cooperation between the flexible support members and their downward travel equally limited by an abutment. Depression of a keylever results in the keylever descending in a path substantially perpendicular to the planes of the flexible support members. The amount of keybutton deflection for each key location is almost identical providing equal dip for all keylevers. The force necessary to restore all keylevers to their rest position is substantially uniform therebetween.

In one embodiment of the invention, the cross arm portion of the keylever has hook appendages at each end. The flexible support members are mounted on the frame member with their free end provided with apertures that engage with the hooks of the cross arm. The first flexible support member is fixed to the frame while the second flexible support member is rotatably supported to provide an inexpensive and simple touch control. In another embodiment of the invention, the flexible support members are mounted on the frame at one end while the other end extends toward, and is integrally connected with the spaced ends of the keylever cross arm. The mounting end portion of one of the flexible support members is of a generally rectangular configuration having flexures emmanating therefrom so that the keylevers are integrally connected to form a unitary keyboard. The keybuttons are integrally connected on the keylever leg. A resilient member underlies the keylever applying reacting biasing force thereon for depression and restoration thereof. The resilient member is adjustably mounted to provide the touch control.

Accordingly, an object of the present invention is to provide a keyboard defined by a low silhouette.

Another object of the present invention is to provide a keyboard of simple and inexpensive construction.

A further object of the present invention is to provide a keyboard having a simplified keyboard touch control.

A still further object of the present invention is to provide a keyboard wherein the keytouch is substantially uniform among keys.

A still further object of the present invention is to provide a keyboard wherein the deflection of all keylevers is substantially uniform.

A still further object of the present invention is to provide a keyboard wherein the keylevers descend in a path closely perpendicular to the plane of the supporting members.

A still further object of the present invention is to provide a keyboard having unitary construction.

Other objects, features, and advantages of the invention will become more apparent from the following description, including appended claims and accompanying drawing.

BRIEF DESCRIPTION OF THE DRAWING

FIG. 1 is a perspective view of one embodiment of a four bank portion of the keyboard made in accordance with the present invention.

FIG. 3 is a side elevation view of a typewriter with the disclosed embodiment therein.

DESCRIPTION OF THE PREFERRED EMBODIMENT

Figure 7:
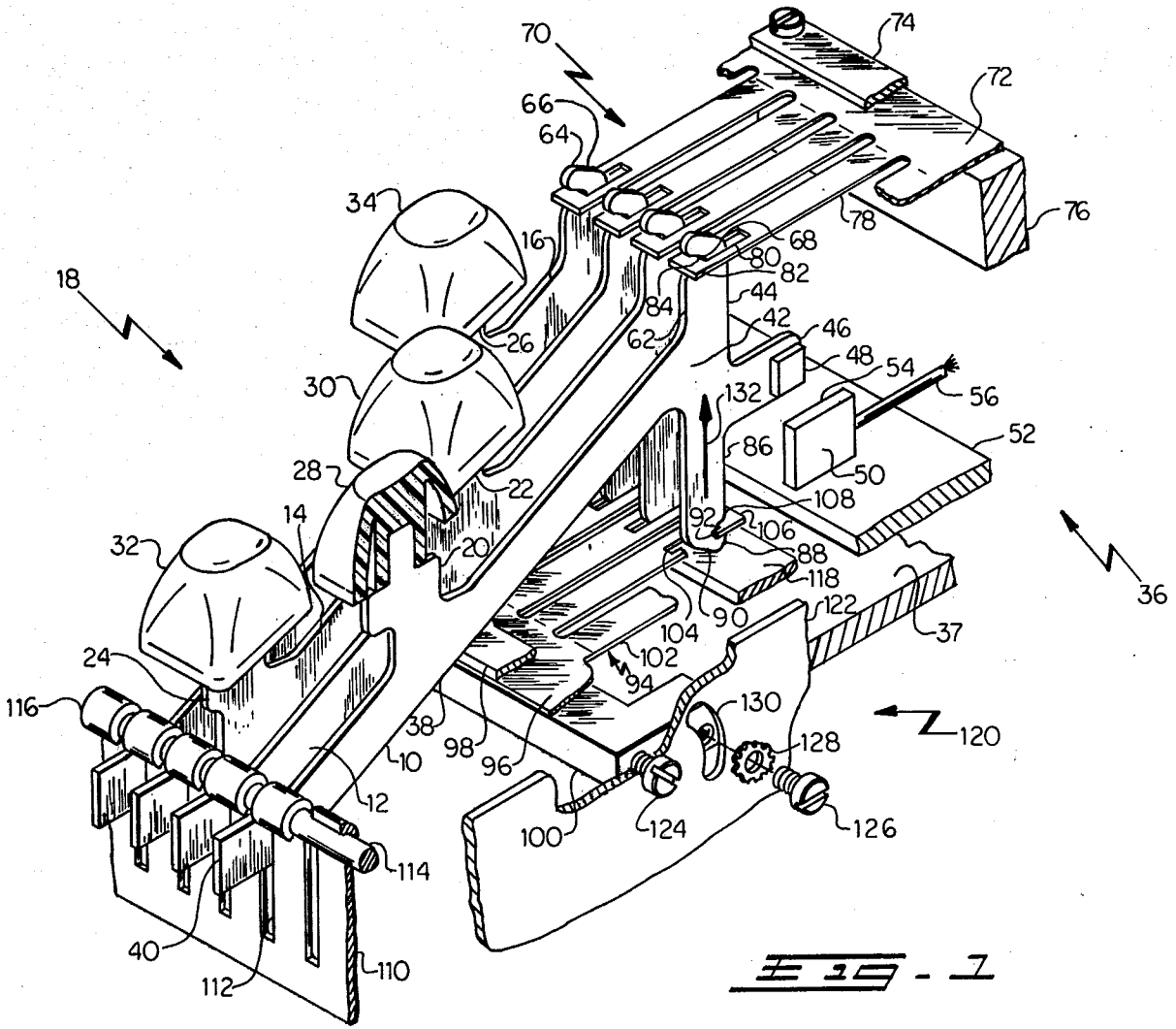
Figure 2:
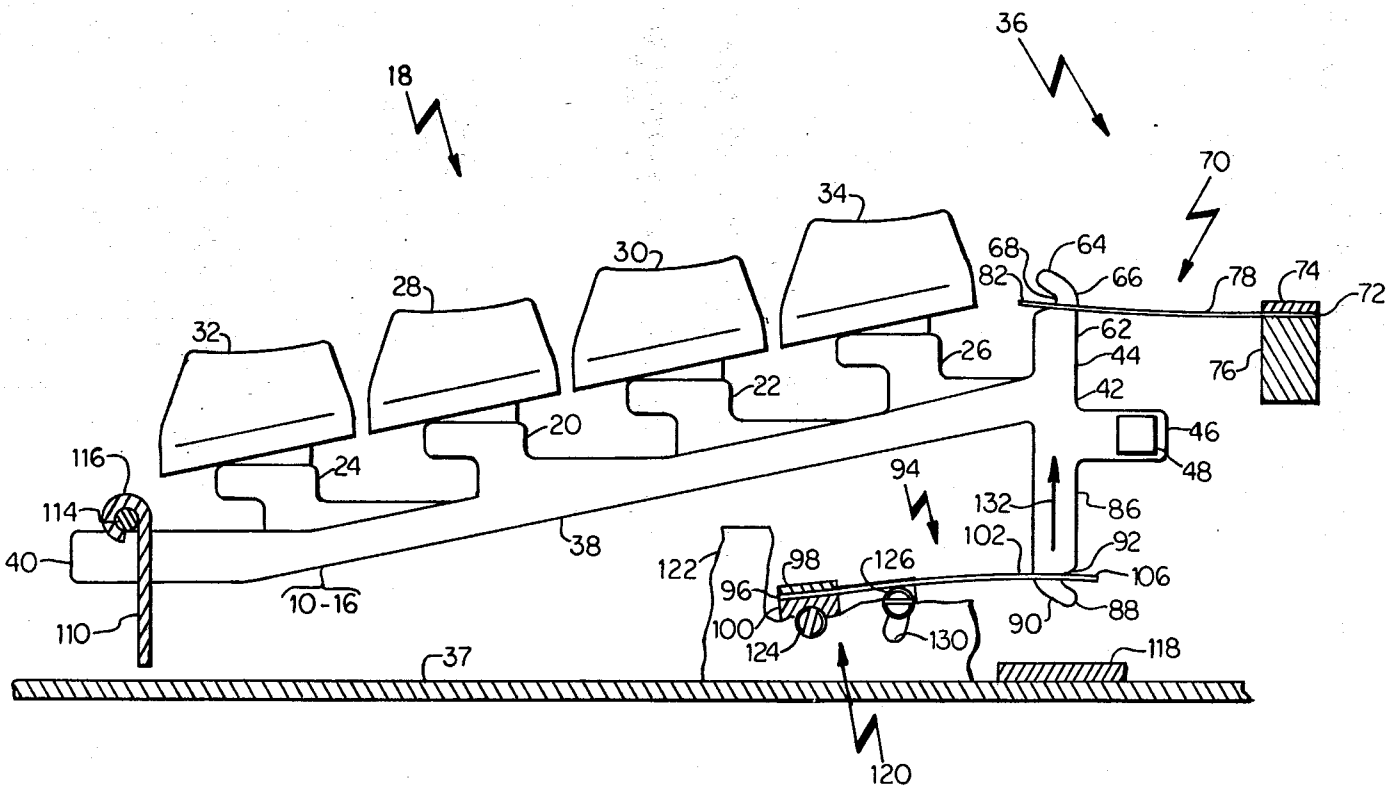
FIG. 2 is a side elevation view of the four bank portion of the keyboard showing the keylevers biased upward.
Figure 5:
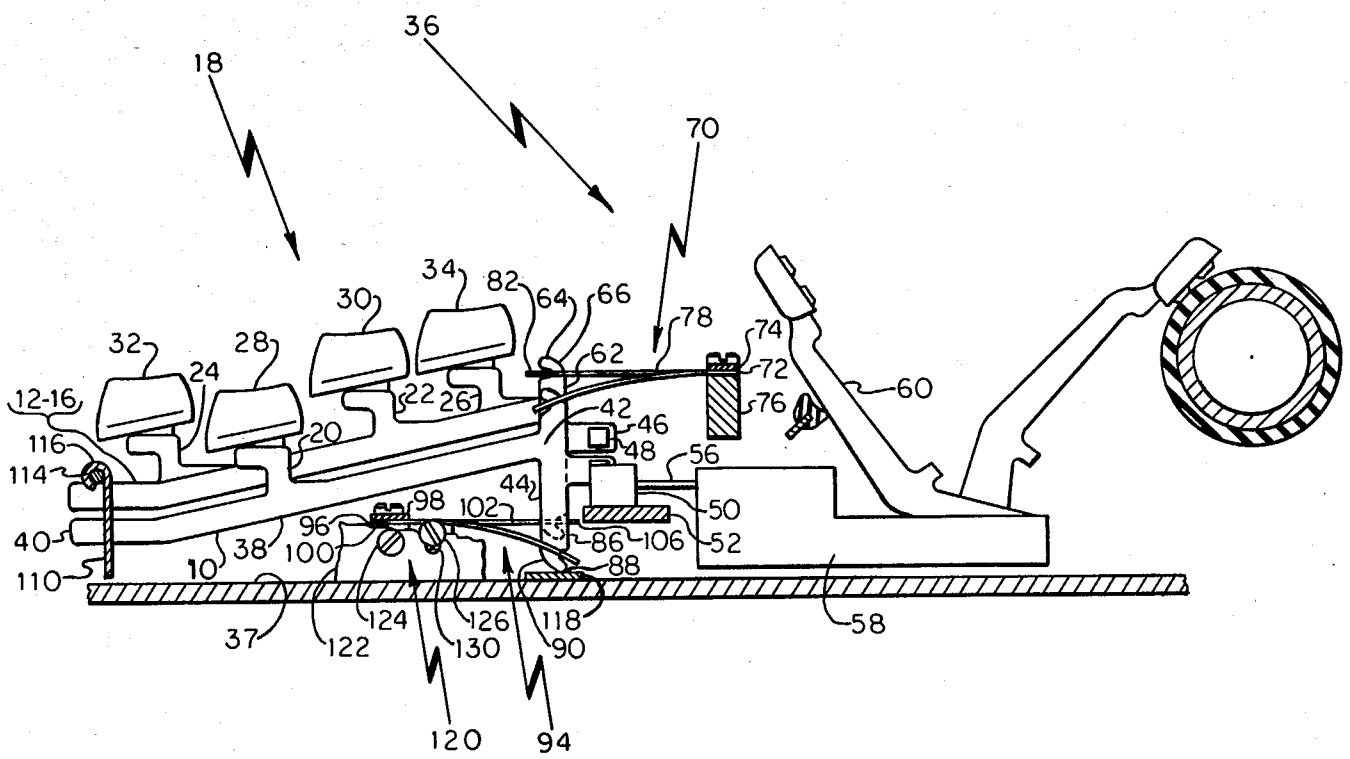

Referring to FIGS. 1, 2 and 3 there is shown one embodiment of the present invention wherein, a plurality of parallel depressable keylevers 10, 12, 14 and 16 each having approximately the same mass are arranged transverse to typewriter keyboard 18. The keylevers 10–16 include upstanding lugs 20, 22, 24 and 26 which typically support thereon, finger-engageable keybuttons 28, 30, 32 and 34. The keybuttons 28–34 are situated at four levels on keyboard 18 of a typewriter 36. Typewriter 36 is supported on a horizontal base 37. Although only four keylevers 10–16 and corresponding keybuttons 28–34 are shown, it is to be understood that other companion keylevers are arranged transverse the keyboard 18 with the keybuttons in rows consistent with the levels as shown.

Inasmuch as all keylever mechanisms are constructed in a similar fashion and for the sake of clarity, the construction of only one keylever mechanism will herein be described. Keylever 10 may be structured of thin plate material and is essentially "T"-shaped. A leg 38 terminates in a straight end 40 and at its other end is integrally connected at junction 42 of a cross arm 44 to form the "T" profile. The upstanding lug 20 is situated on leg 38 approximately intermediate the end 40 and junction 42. Cross arm 44 includes a rearward extending projection 46 slightly below junction 42 and carries magnet 48. A sensor device 50 is mounted on a board 52 below proximate one side 54 of magnet 48. As indicated in FIG. 3, a wire 56 connects sensor device 50 with an actuator mechanism 58 for operation of a typebar 60 when magnet 48 is displaced by movement of the keylever 10 so as to pass adjacent sensor 50. Such sensor device 50 construction if desired, may actuate a logic encoder system for operating a remote printer or such.

Referring to FIGS. 1 and 2, the cross arm 44 is positioned toward the rear of keyboard 18 and includes an upstanding extension 62 projecting above junction 42 terminating at end 64. End 64 is constructed in the form of a hook appendage 66 having a hooking surface 68. A first flexible keylever support member 70 includes an anchored support section 72 of a generally rectangular configuration that is fixedly supported between a bar 74 and an upper frame 76. Upper frame 76, bar 74 and support section 72 extend transverse keyboard 18. The first keylever support member 70 further includes a plurality of flexures 78 emanating from the length of support section 72 and extending in a direction toward the keylever 10. There is provided at least one flexure 78 on flexible keylever support member 70 for each of the keylevers 10–16. Each flexure 78 is provided with an aperture 80 at its free end 82. An outermost edge 84 of aperture 80 is engaged with hooking surface 68 of hook appendage 66. This engagement connection is such that, when keylever 10 reciprocates, free end 82 is moved therewith, bending flexure 78 with little lost motion therebetween.

Cross arm 44 has a downstanding extension 86 having a length substantially equal to extension 62 that projects below junction 42 terminating at end 88 having a similar shape as end 64. End 88 includes a hook appendage 90 having a hooking surface 92. A second flexible keylever support member 94 is identical to the first flexible keylever support member 70 and has its support section 96 fixedly mounted between a second bar 98 and a lower frame 100. Lower frame 100, bar 98 and support section 96 extend transverse keyboard 18. The second keylever support member 94 also includes a plurality of flexures 102 emanating from the length of support section 96. Flexures 102 are aligned with individual keylevers 10–16 and extend thereto in opposed relationship with the flexures 78 of flexible keylever support member 70. Each flexure 102 has an aperture 104 at its free end 106. An outermost edge 108 of aperture 104 is operatively engaged with hooking surface 92 of hook appendage 90. Thus the cross arm 44 is coupled at its ends 64 and 88, to opposed pairs of flexible keylever support members 70 and 94. The ends 64 and 88 when coupled, are vertically aligned in relationship to base 37. Each flexible keylever support member 70 and 94 is constructed from a resilient material such as spring steel.

An elongated guide comb 110 is located at the front portion of keyboard 18 and includes a plurality of vertical guide slots 112 that cooperate with and vertically guide straight end 40 of the keylevers 10–16. The keylevers 10–16 are laterally constrained within guide slots 112 and limited in their upward movement by an elongated resilient upstop 114 that is slideably trapped in guide comb 110 by a plurality of substantially wraparound ears 116. Guide comb 110 and upstop 114 are shown being constructed from a metal material, however, they may be integrally molded from a plastic material. Keylevers 10–16 are at rest when their straight end 40 abuts upstop 114. The end 40 of each keylever 10–16 is only guided in a vertical direction by guide comb 110 during keylever reciprocation.

Each cross arm 44 of keylevers, 10–16 is supported, guided and biased to its normalized rest position by the operative engagement of hook appendages 66 and 90 with flexible keylever support members 70 and 94, respectively. It can therefore be seen that, keylevers 10–16 are entirely supported and biased by the engagement of the keylevers 10–16 and opposed flexible keylever support members 70 and 94. Initial upward biasing force applied to the keylevers 10–16, due to the tension of the opposed flexible keylever support members 70 and 94 is sufficient to hold the keylevers 10–16 in their rest position. Further, because of the resiliency of flexible keylever support members 70 and 94, they are capable of restoring keylevers 10–16 to their rest position after depression thereof. Downward movement of each keylever 10–16 is limited by an underlying abutment 118 being vertically aligned with cross arm end 88.

An adjustable key tough mechanism, generally indicated by 120, is provided for varying the initial upward biasing force applied to the keylevers 10–16 by the flexible keylever support members 70 and 94. Key touch mechanism 120 includes lower frame 100 which carries member 94 being pivotally mounted between typewriter side frames 122 by a pivot screw 124 and a locking screw 126 extending through a lock washer 128 and curved slot 130 in side frame 122. By loosening screws 124 and 126, lower frame 100 may be rotated about a pivot defined by screw 124. The resultant of which simultaneously varies by substantially the same amount the biasing effect applied to all keylevers 10–16.

Since the flexible keylever support members 70 and 94 are identically opposed having their connection with keylever 10 vertically aligned, the resulting biasing force applied thereto is in a vertically upward direction as indicated by arrow 132. There is no lateral resultant force an keylever cross arm 44 and therefore, it will move substantially in a vertical direction during keylever 10 depression regardless of keybutton 28–34 location along keylever leg 38. Because of vertical movement of cross arm 44 there is substantially no difference in mechanical advantage between the keylevers 10–16 and all keylevers 10–16 having substantially the same mass, therefore the reacting biasing force required for depression and restoration of all keylevers 10–16 regardless of row position is substantially equal. All keylevers 10–16 have equal dip between their rest position and abutment 118 depression limit and with substantially no mechanism therebelow, thus providing a keyboard 18 conducive to a low silhouette profile wherein, the only height restriction between the tops of keybuttons 28–34 and the machine base 37 is the vertical keylever 10–16 displacement.

Figure 4:
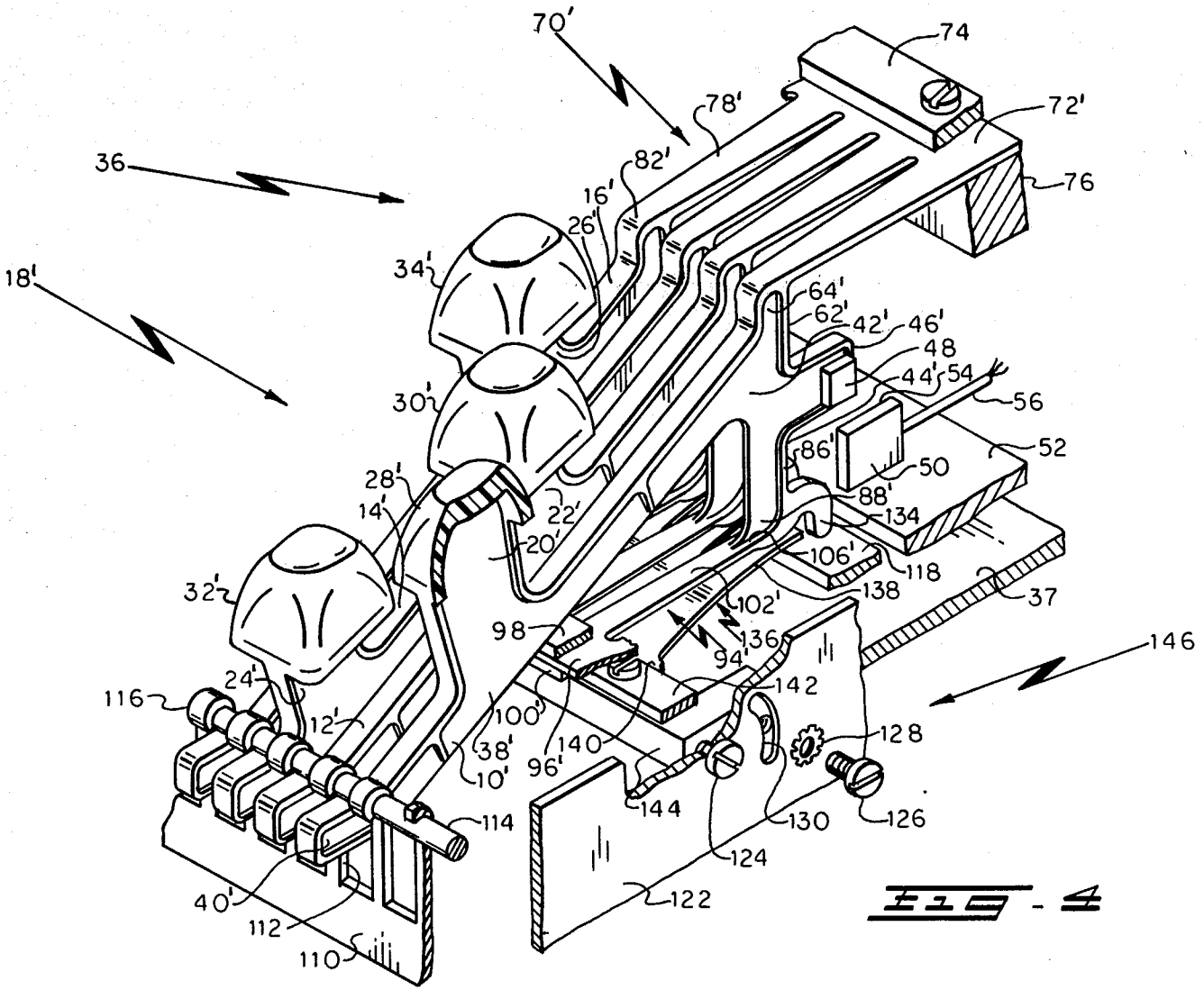
FIG. 4 is a perspective view of another embodiment of a four bank portion of the keyboard made in accordance with the present invention.

The embodiment of the present invention shown in FIGS. 1–3, include a pair of flexible keylever support members 70 and 94 that need to be assembled to individual keylevers 10–16. Referring to FIG. 4 wherein a second embodiment of the invention is shown providing a low silhouette keyboard 18' having its keylevers 10'–16' integrally connected with the flexible keylever support members 70' and 94'. Further, the keylevers 10'–16' are interconnected at the support sections 72' and 96' of the flexible support members 70' and 94' to define a unitary keyboard 18'. For clarity and ease of comparison, structure appearing in FIG. 4 corresponding to similar structure appearing in FIG. 1, have primed reference numbers. In this keyboard 18', keylevers 10'–16', keybuttons 28'–34' and flexible keylever support members 70' and 94' are simultaneously molded from a plastic material. The keybuttons 28'–34' being preferrably integrally connected on lugs 20'–26' of keylever leg 38' to correspond to the different rows of a four bank keyboard 18'. However, the lugs 20'–26' may be molded to provide support structure for a keybutton to be mounted thereon. Ends 64' and 88' of cross arm 44' are integrally connected with ends 82' and 106' of flexures 78' and 102', respectively. End 88' is provided with a downstanding projection 134 for cooperation with abutment 118 to limit vertical descention of keylever 10' when depressed. Flexible keylever support member 94' has support section 96' mounted between bar 98 and frame 100' that is now rigidly fixed between typewriter side frames 122. A resilient flat leaf spring 136, preferably constructed from a spring steel material, has a plurality of fingers 138 that extend from its mounted end 140 to engage by underlying end 88' of cross arm 44'.

Leaf spring 136 is mounted in cantilever fashion having end 140 between a plate 142 and a frame member 144. Leaf spring 136 provides initial upward biasing force which is applied to the keylever 10' for maintaining keylever rest position and, when keylever 10' is released from depression having sufficient force for restoration thereof to its rest position. Frame 144, bar 142 and leaf spring 136 extend transverse keyboard 18'. An adjustable keytouch mechanism 146 similar to mechanism 120 of FIG. 1 is provided for varying the initial upward biasing force applied to keylevers 10'-16'. Keytouch mechanism 146 includes frame 144 which carries spring 136 being pivotally mounted between typewriter side frames 122.

While the foregoing description has shown and described the fundamental novel features as applied to the preferred embodiments, it will be understood by those skilled in the art that modifications embodied in various forms may be made without departing from the spirit and scope of the invention.

What is claimed is:

1. A keyboard for business machines having a frame, the keyboard comprising:

a plurality of T-shaped keylevers including a vertical extending cross arm forming a portion of said T-shape;

a first flexible keylever support member for each of said plurality of keylevers having one end fixedly supported on the frame and horizontally extending straight toward one of said keylevers in one direction;

a second flexible keylever support member for each of said plurality of keylevers having one end fixedly supported on the frame and horizontally extending straight toward said one keylever in an opposite direction from said first flexible keylever support member;

a first movable connection means coupling said first flexible keylever support member to said one keylever at one end of said cross arm;

a second movable connection means coupling said second flexible keylever support member to said one keylever at an opposite end of said cross arm vertically spaced from said one end of said cross arm; and said first and second movable connection means cooperate in response to depression of said one keylever to nullify horizontal forces effecting the directional movement of said one keylever thereby resulting in controlled movement of said one keylever in a vertical direction.

2. A keyboard as defined in claim 1 wherein each one of said T-shaped keylevers includes a leg horizontally extending from said cross arm intermediate said opposite ends of said cross arm, said first flexible keylever support member being connected to said cross arm above said keylever leg, and said second flexible keylever support member being connected to said cross arm below said keylever leg.

3. A keyboard as defined in claim 2 wherein each one of said T-shaped keylevers includes a keybutton supported on said leg for depression of said keylever.

4. A keyboard as defined in claim 1 wherein each one of said T-shaped keylevers is integrally molded with said first and second support members at vertically spaced opposite ends of said cross arm.

5. A keyboard as defined in claim 4 wherein each one of said T-shaped keylevers includes a keybutton integrally molded therewith intermediate its ends for depression thereof.

6. A keyboard as defined in claim 5 further comprising resilient means engageably underlying said one keylever for applying upward biasing force thereon sufficient to maintain said one keylever at a rest position and to assist upward biasing forces from said first and second flexible support member thereby collectively enabling restoration to rest position of said one keylever when released from depression.

7. A keyboard as defined in claim 6 wherein said resilient means is a flat spring.

8. A keyboard as defined in claim 1 wherein said one end of one of said flexible keylever support member supported on the frame is adjustable by having an adjustable means rotatably connected to the frame for positioning said one support member relative to all of said keylevers, and the other end of said one support member where coupled to said one end of said cross arm is spaced the same distance from the frame for all of said keylevers for varying upward biasing force applied thereto at a substantially simultaneous and uniform rate.

9. A keyboard as defined in claim 1 wherein said first movable connection means includes an aperture on said first flexible keylever support member and a hook appendage having a curved hooking surface on said one end of said cross arm, said hook appendage extends through said aperture to have an overlapping relationship with said first flexible support member for engaging an outermost edge of said aperture by said curved hooking surface and for sustaining said engagement between said curved hooking surface and said ouermost edge of said aperture.

10. A keyboard as defined in claim 1 wherein said second movable connection means includes an aperture on said second flexible keylever support member and a hook appendage having a curved hooking surface on said opposite end of said cross arm, said hook appendage extends through said aperture to have an overlapping relationship with said second flexible support member for engaging an outermost edge of said aperture by said curved hooking surface and for sustaining engagement between said curved hooking surface and said outermost edge of said aperture.

* * * * *